US010143310B1

(12) United States Patent
Wang

(10) Patent No.: US 10,143,310 B1
(45) Date of Patent: Dec. 4, 2018

(54) ROTARY POSITIONING DEVICE FOR ARMREST ASSEMBLY

(71) Applicant: CHUAN HSING CHEMICAL INDUSTRY CO., LTD., Taichung (TW)

(72) Inventor: Ching-Chang Wang, Taichung (TW)

(73) Assignee: Chuan Hsing Chemical Industry Co., Ltd., Taichung (TW)

( * ) Notice: Subject to any disclaimer, the term of this patent is extended or adjusted under 35 U.S.C. 154(b) by 0 days.

(21) Appl. No.: 15/613,681

(22) Filed: Jun. 5, 2017

(51) Int. Cl.
*A47C 7/54* (2006.01)
*A47C 1/03* (2006.01)

(52) U.S. Cl.
CPC . *A47C 7/54* (2013.01); *A47C 1/03* (2013.01)

(58) Field of Classification Search
CPC .. A47C 1/03; A47C 7/54; A47C 7/546; F16B 21/06
See application file for complete search history.

(56) References Cited

U.S. PATENT DOCUMENTS

2003/0178882 A1* 9/2003 Schmitz ..... A47C 1/03255 297/411.36
2007/0057560 A1* 3/2007 Fookes ..... A47C 1/03 297/411.35
2008/0191104 A1* 8/2008 Wang ..... A47C 1/03 248/118
2011/0248543 A1* 10/2011 Hitchcock ..... A47C 1/03 297/411.36
2012/0205958 A1* 8/2012 Colasanti ..... A47C 1/03 297/411.36

FOREIGN PATENT DOCUMENTS

JP 2010-63833 * 3/2010
JP 5263823 * 8/2013

OTHER PUBLICATIONS

English Abstract of JP02010063833A, Ueda et al., Mar. 25, 2010. (Year: 2010).*
English Abstract of JP005263823B2, Aug. 14, 2013. (Year: 2013).*

* cited by examiner

*Primary Examiner* — Vinh Luong
(74) *Attorney, Agent, or Firm* — Alan D. Kamrath; Kamrath IP Lawfirm, P.A.

(57) ABSTRACT

A rotary positioning device for an armrest includes a positioning member, a base, a sliding member, and a detent member. The positioning member includes a plurality of first engaging recesses formed at a side edge thereof. The base is rotatably connected to the positioning member. The sliding member is slidably arranged in base and is selectively switchable between a locked position and an unlocked position. The detent member is movably arranged in the base and is selectively engaged with one of the plurality of first engaging recesses to correspond to the locked position or the unlocked position of the sliding member.

5 Claims, 6 Drawing Sheets

ROTARY POSITIONING DEVICE FOR ARMREST ASSEMBLY

BACKGROUND OF THE INVENTION

The present invention relates to a rotary positioning device and, particularly, to a rotary positioning device applied in an armrest assembly.

A pair of armrests is associated with chairs to provide support for forearms of users while working despite the differences in sizes, shapes and preferences of users. This is important for individuals having desk jobs where persons may stay seated for long periods of time and where different users use the same sized chair. It is also important for users that are different in size to be able to adjust the armrest to a lateral position that is comfortable for them. In this regard it is common for the armrest to be selectively rotatable in relation to a support member about a vertical axis.

However, the above arrangement of the armrest and the support is not stable. The armrest is easily rotated in relation to the support member due to an inadvertent force from the forearm of the user.

The present invention is, therefore, intended to obviate or at least alleviate the problems encountered in the prior art.

BRIEF SUMMARY OF THE INVENTION

A rotary positioning device includes a positioning member, a base, a sliding member, a detent member, and an elastic member.

The positioning member is adapted to be mounted on a support member. The positioning member has a first side and a second side opposite to the first side. The positioning member includes a plurality of first engaging recesses formed at the first side in a circumferential direction of the positioning member. Two adjacent first engaging recesses of the plurality of first engaging recesses are separated from each other at an angle less than 60 degrees in the circumferential direction.

The base is rotatably connected to the positioning member. The base includes a rotary recess, a sliding recess, a connection recess interconnected between the rotary recess and the sliding recess, and a guiding portion protruded from a bottom face of the sliding recess. The rotary recess rotatably receives the positioning member. The sliding recess includes a first connecting portion protruded from an inner face of the sliding recess.

The sliding member is slidably arranged in the sliding recess of the base and is selectively switchable between a locked position and an unlocked position. The sliding member includes a side face and a receiving recess depressedly formed at the side face. The receiving recess has a depth in relation to the side face. The sliding member has a proximal end and a distal end opposite to the proximal end. The distal end is provided with a second connecting portion. The sliding member further includes a guiding recess extending from the proximal end to the distal end. The guiding recess is slidably engaged with the guiding portion of the base.

The detent member is movably arranged in the connection recess of the base. The detent member is selectively engaged with one of the plurality of first engaging recesses of the positioning member or is received in the receiving recess of the sliding member. The detent member has an outer diameter greater than the depth of the receiving recess.

The elastic member has a first end connected to the first connecting portion of the sliding recess, and a second end connected to the second connecting portion of the distal end of the sliding member.

When the sliding member is in the locked position, the detent member is engaged with one of the plurality of first engaging recesses of the positioning member and is abutted against the side face of the sliding member. The base is unable to rotate in relation to the positioning member.

When the sliding member is in the unlocked position, the detent member is moved in relation to the connection recess of the base to be disengaged from one of the plurality of first engaging recesses of the positioning member and is received in the receiving recess of the sliding member. The distal end of the sliding member compresses against the elastic member. The base is able to rotate in relation to the positioning member.

The present invention will become clearer in light of the following detailed description of illustrative embodiments of this invention described in connection with the drawings.

DETAILED DESCRIPTION OF THE INVENTION

Figure 1:
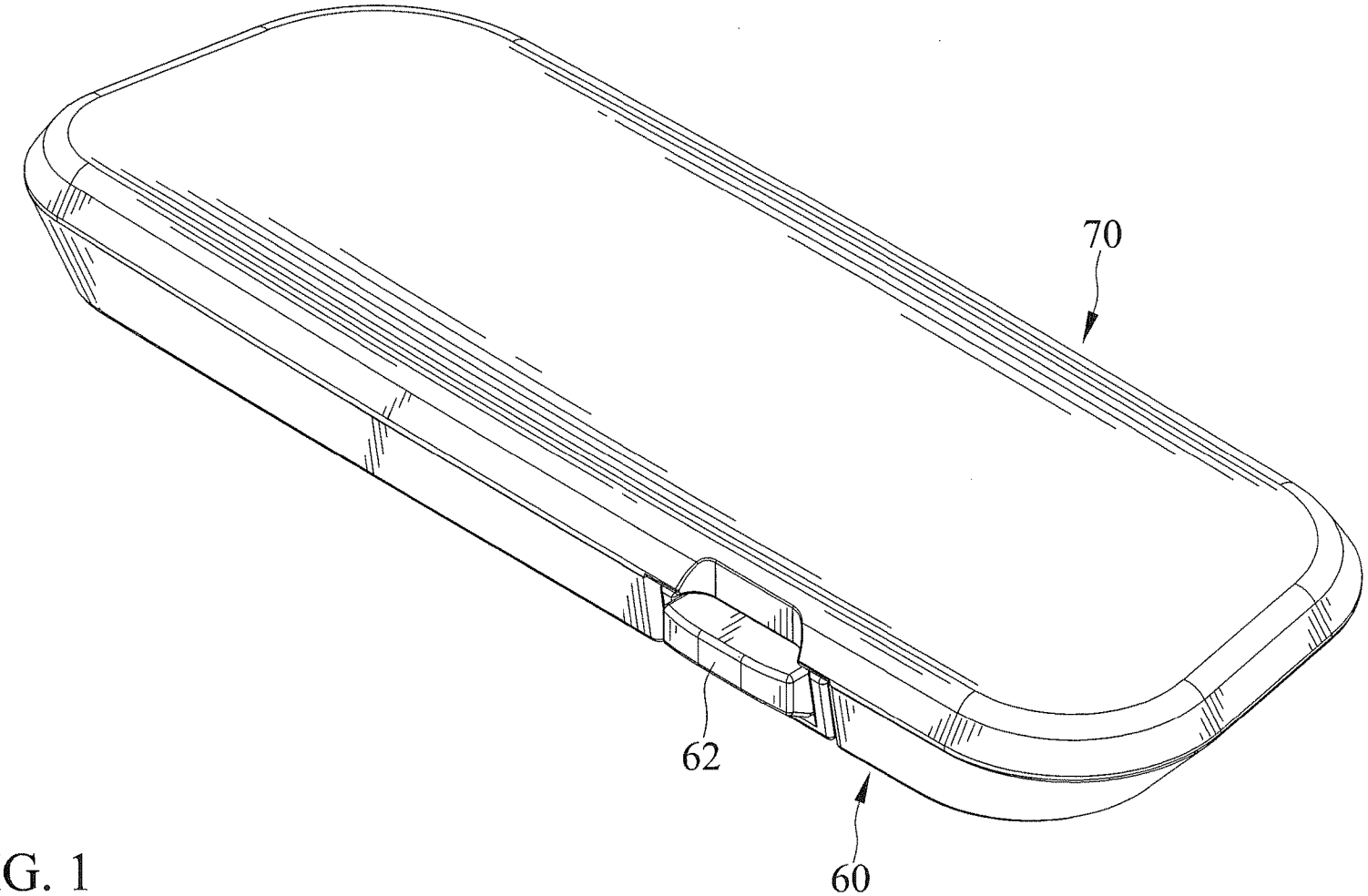
FIG. 1 is a perspective view of a rotary positioning device according to the present invention.
Figure 2:
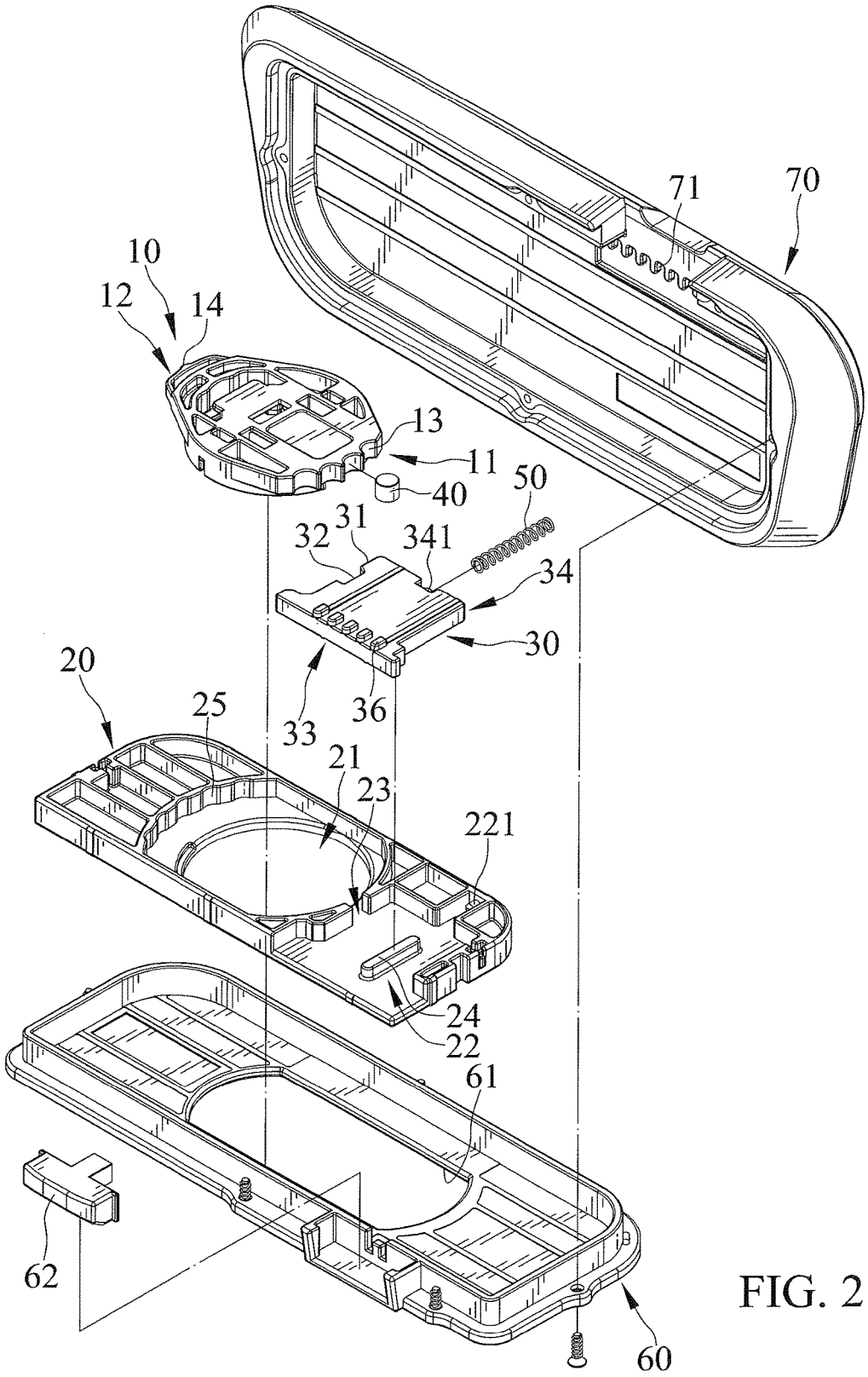
FIG. 2 is an exploded perspective view of the rotary positioning device of FIG. 1.
Figure 3:
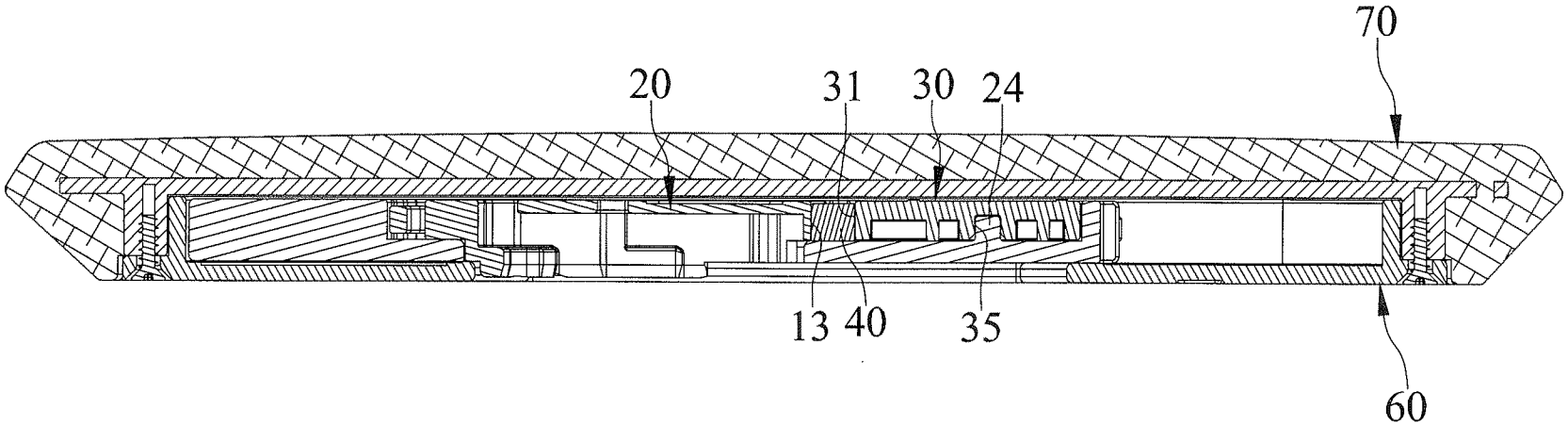
FIG. 3 is a cross-section view of the rotary positioning device of FIG. 1.
Figure 4:
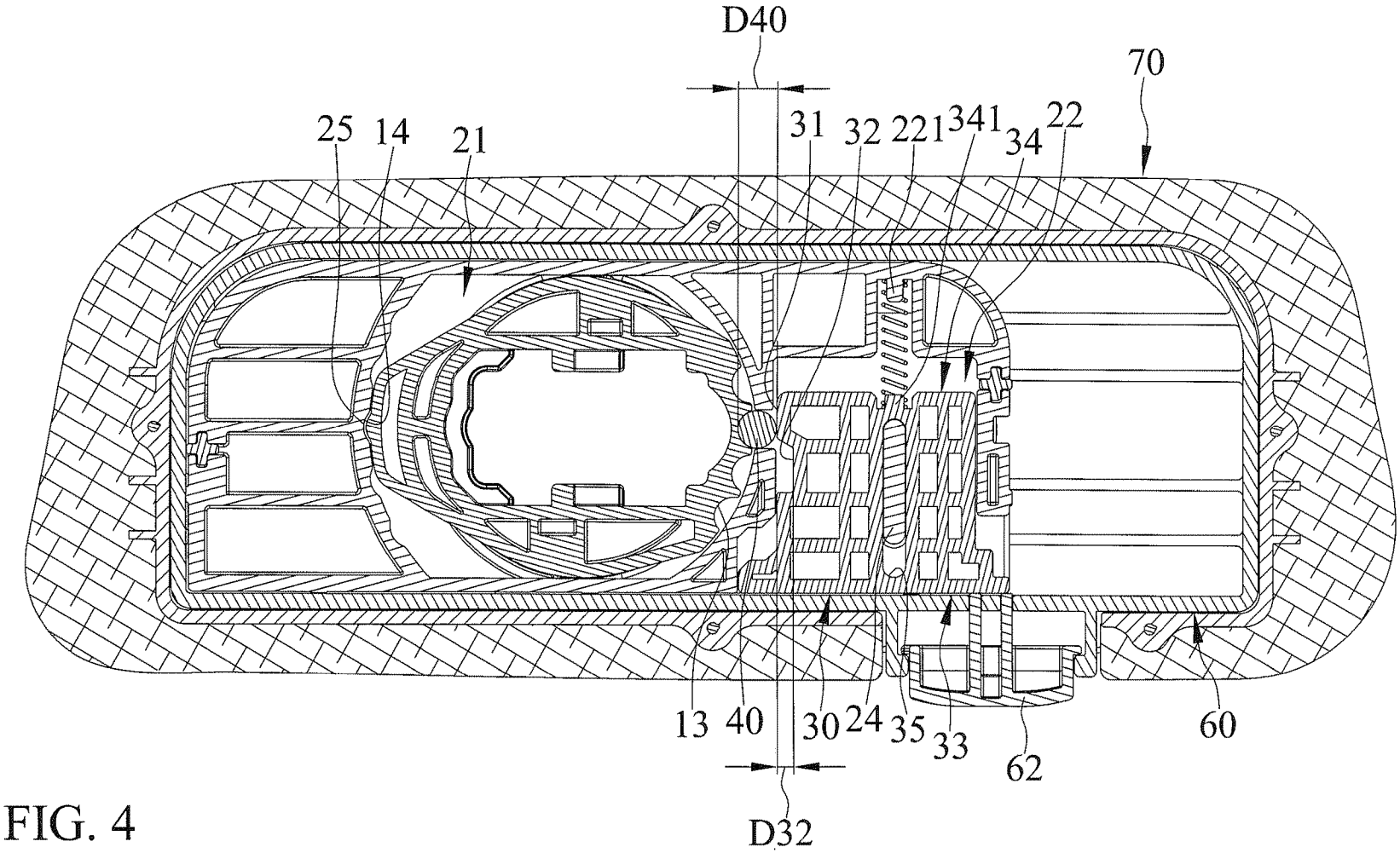
FIG. 4 is a cross-section view of the rotary positioning device of FIG. 1 and illustrates a sliding member located in a locked position.
Figure 5:
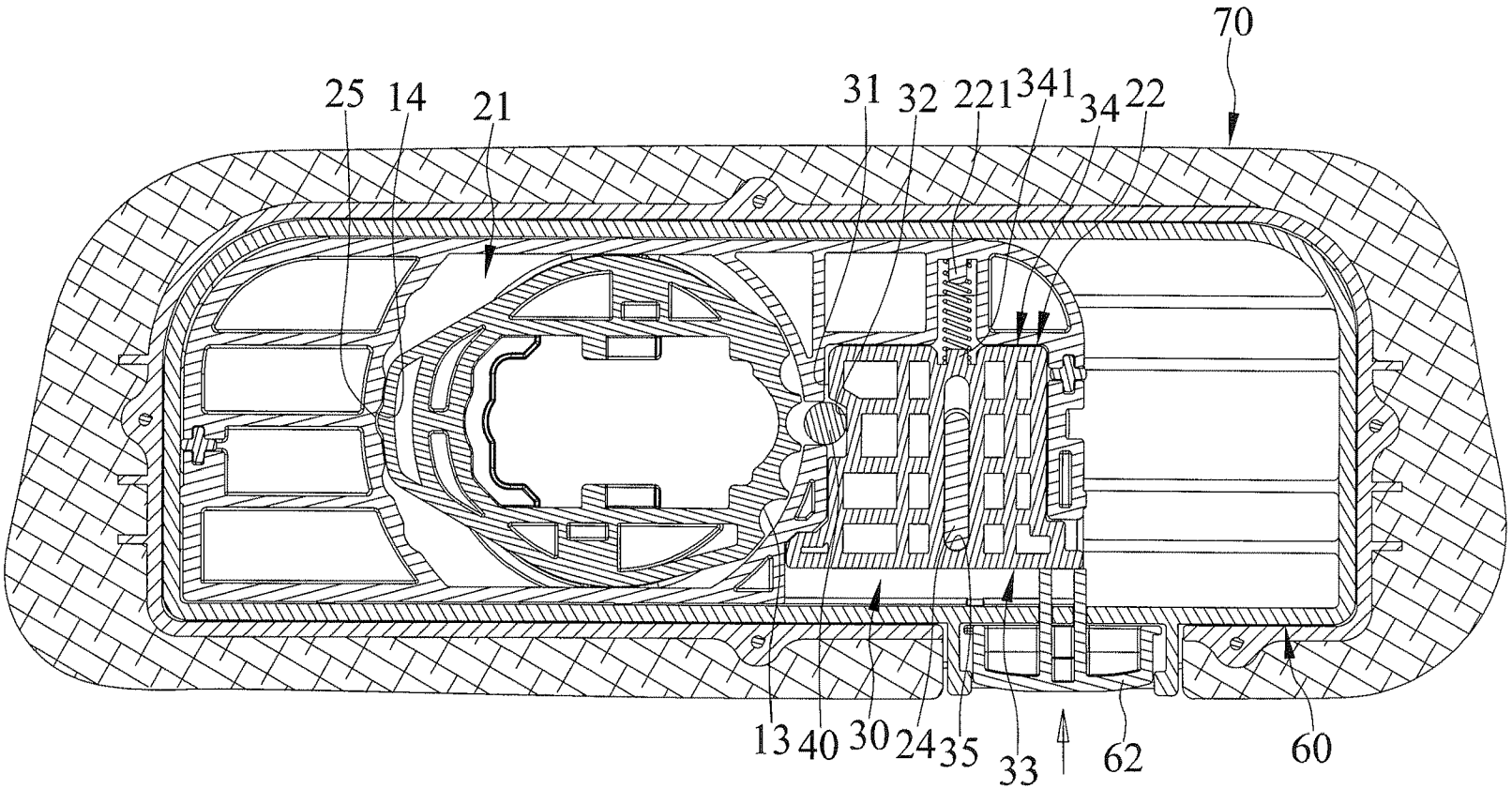
FIG. 5 is a continued view of FIG. 4 and illustrates the sliding member switched from the locked position to an unlocked position.
Figure 6:
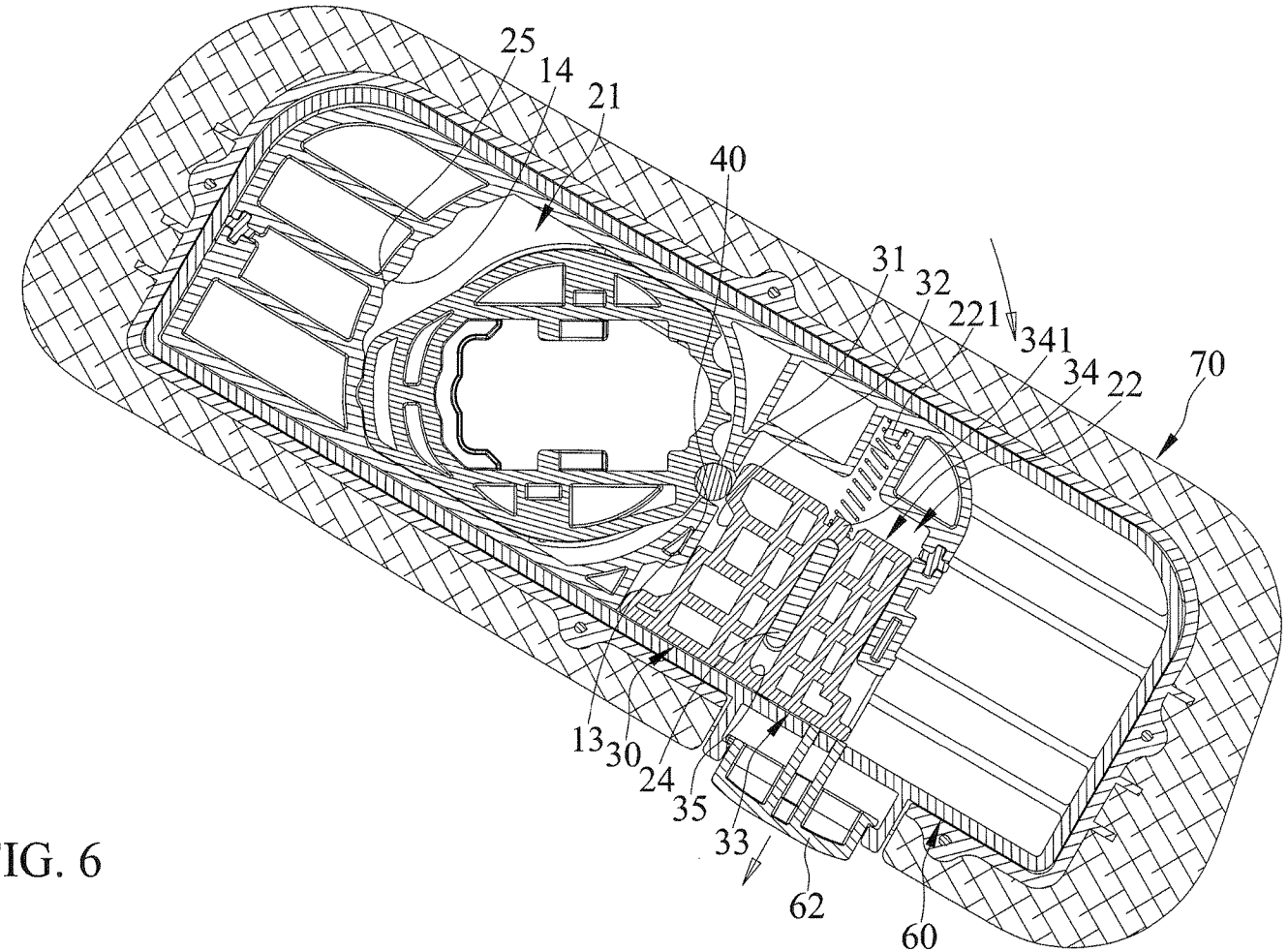
FIG. 6 is a continued view of FIG. 5 and illustrates a base rotated in relation to a positioning member and then the sliding member switched from the unlocked position to the locked position.

FIGS. 1-6 show a rotary positioning device according to the present invention. The rotary positioning device includes a positioning member 10, a base 20 rotatably connected to positioning member 10, a sliding member 30 slidably arranged in base 20, a detent member 40 movably arranged in base 20, an elastic member 50 located between base 20 and sliding member 30, a first housing 60 receiving base 20, and a second housing 70 detachably mounted on first housing 60.

Positioning member 10 is adapted to be mounted on a support member (not shown). Positioning member 10 includes a first side 11, a second side 12 opposite to first side 11, a plurality of first engaging recesses 13 formed at first side 11 in a circumferential direction of positioning member 10, and an engaging portion 14 radially protruded from second side 12. Two adjacent first engaging recesses 13 may be separated from each other at an angle less than 60 degrees in the circumferential direction. However, depending on the state, the angle formed between two adjacent first engaging recesses 13 also can be less than 45 degrees, 30 degrees, etc. Plurality of first engaging recesses 13 and engaging portion 14 may be integrally formed at first and second sides 11 and 12, respectively.

Base 20 includes a rotary recess 21, a sliding recess 22, a connection recess 23 interconnected between rotary recess 21 and sliding recess 22 along a length direction, a guiding portion 24 protruded from a bottom face of sliding recess 22 along a height direction and extending along a width direction, and a plurality of second engaging recesses 25 formed on an inner wall of rotary recess 21 in a circumferential direction of rotary recess 21. Rotary recess 21 rotatably received positioning member 10. Sliding recess 22 slidably receives sliding member 30. Rotary recess 21 includes a first connecting portion 221 protruded from an inner face of sliding recess 22 along the width direction. One of plurality of second engaging recesses 25 is selectively engaged with engaging portion 14.

Sliding member 30 is slidably arranged in sliding recess 22 along the width direction and is selectively switchable between a locked position and an unlocked position. Sliding member 30 includes a side face 31, a receiving recess 32 depressedly formed at side face 31 along the length direction and extending along the width direction, a proximal end 33, a distal end 34 opposite to proximal end 33, a guiding recess 35 formed on a bottom face of sliding member 30 and extending from proximal end 33 to distal end 34 along the width direction, and a plurality of positioning portions 36 protruded from a top face of sliding member 30 along the height direction and equally spaced from each other along the length direction. Side face 31 and receiving recess 32 can be faced to connection recess 23. Receiving recess 32 has a depth D32 in relation to side face 31 along the length direction. Distal end 34 is provided with a second connecting portion 341 on an end face thereof. Guiding recess 35 does not penetrate through the top face of sliding member 30 and is slidably engaged with guiding portion 24 along the width direction.

Detent member 40 is movably arranged in connection recess 23 along the length direction to be selectively engaged with one of plurality of first engaging recesses 13 or to be received in receiving recess 32. Detent member 40 may be cylindrical and has an outer diameter D40 greater than depth D32 of receiving recess 32.

Elastic member 50 having a first end connected to first connecting portion 221 of sliding recess 22, and a second end connected to second connecting portion 341 of distal end 34 of sliding member 30.

First housing 60 includes a through-hole 61 interconnected with rotary recess 21, and a button 62 slidably mounted in first housing 60 along the width direction. Positioning member 10 protrudes out of first housing 60 via through-hole 61 to be mounted on the support member. Button 62 abuts against proximal end 33 of sliding member 30.

Second housing 70 is threadedly mounted on first housing 60. Base 20 is disposed between first and second housings 60 and 70 to form an armrest assembly to provide support for the forearm of a user. Second housing 70 includes a plurality of positioning recesses 71 selectively engaged with plurality of positioning portions 36 of sliding member 30. Moreover, second housing 70 may be covered by soft materials.

When sliding member 30 is in the locked position, detent member 40 is engaged with one of plurality of first engaging recesses 13 of positioning member 10 and is received in connection recess 23 of base 20. Detent member 40 is abutted against side face 31 of sliding member 30. One of plurality of second engaging recesses 25 of base 20 is engaged with engaging portion 14 of positioning member 10. Plurality of positioning recesses 71 of second housing 70 is engaged with plurality of positioning portions 36 of sliding member 30. Thus, base 20 is unable to rotate in relation to positioning member 10 to provide a stable engagement therebetween.

The user can push button 62, thereby button 62 slides in relation to first housing 60 along the width direction to abut against proximal end 33 of sliding member 30 to cause sliding member 30 switched from the locked position to the unlocked position. Distal end 34 of sliding member 30 compresses against elastic member 50 to cause elastic member 50 compressed between the inner face of sliding recess 22 and distal end 34 of sliding member 30.

When sliding member 30 is in the unlocked position, detent member 40 is moved in relation to connection recess 23 of base 20 along the length direction to be disengaged from one of plurality of first engaging recesses 13 of positioning member 10 and is received in receiving recess 32 of sliding member 30. Plurality of positioning portions 36 of sliding member 30 is disengaged from plurality of positioning recesses 71 of second housing 70. Thus, base 20 is able to rotate in relation to positioning member 10.

When the user stops pushing button 62, sliding member 30 is automatically return from the unlocked position to the locked position under the elastic restoring force of elastic member 50. Detent member 40 is engaged with another one of plurality of first engaging recesses 13 of positioning member 10 to achieve the angle adjustment of positioning member 10 and base 20.

Although specific embodiments have been illustrated and described, numerous modifications and variations are still possible without departing from the scope of the invention. The scope of the invention is limited by the accompanying claims.

The invention claimed is:

1. A rotary positioning device comprising:

a positioning member configured to be mounted on a support member, with the positioning member having a first side and a second side opposite to the first side, with the positioning member including a plurality of first engaging recesses formed at the first side in a circumferential direction of the positioning member, with two adjacent first engaging recesses of the plurality of first engaging recesses separated from each other at an angle less than 60 degrees in the circumferential direction;

a base rotatably connected to the positioning member, with the base including a rotary recess, a sliding recess, a connection recess interconnected between the rotary recess and the sliding recess, and a guiding portion protruded from a bottom face of the sliding recess, with the rotary recess rotatably receiving the positioning member, with the sliding recess including a first connecting portion protruded from an inner face of the sliding recess;

a sliding member slidably arranged in the sliding recess of the base and selectively switchable between a locked position and an unlocked position, with the sliding member including a side face and a receiving recess depressedly formed at the side face, with the receiving recess having a depth in relation to the side face, with the sliding member having a proximal end and a distal end opposite to the proximal end, with the distal end provided with a second connecting portion, with the sliding member further including a guiding recess extending from the proximal end to the distal end, with the guiding recess slidably engaged with the guiding portion of the base;

a detent member movably arranged in the connection recess of the base, with the detent member selectively engaged with one of the plurality of first engaging recesses of the positioning member or received in the receiving recess of the sliding member, with the detent member having an outer diameter greater than the depth of the receiving recess; and an elastic member having a first end connected to the first connecting portion of the sliding recess, and a second end connected to the second connecting portion of the distal end of the sliding member;

wherein when the sliding member is in the locked position, the detent member is engaged with one of the plurality of first engaging recesses of the positioning member and is abutted against the side face of the sliding member, wherein the base is unable to rotate in relation to the positioning member;

wherein when the sliding member is in the unlocked position, the detent member is moved in relation to the connection recess of the base to be disengaged from one of the plurality of first engaging recesses of the positioning member and is received in the receiving recess of the sliding member, wherein the distal end of the sliding member compresses against the elastic member, wherein the base is able to rotate in relation to the positioning member.

2. The rotary positioning device as claimed in claim 1, with the guiding recess formed on a bottom face of the sliding member and not penetrating through a top face of the sliding member.

3. The rotary positioning device as claimed in claim 2, with the positioning member including an engaging portion radially protruded from the second side, with the base including a plurality of second engaging recesses formed on an inner wall of the rotary recess, and with the engaging portion selectively engaged into one of the plurality of second engaging recesses.

4. The rotary positioning device as claimed in claim 3, further comprising:

a first housing including a through-hole interconnected with the rotary recess of the base, and a button slidably mounted in the first housing, with the positioning member protruding out of the first housing via the through-hole to be mounted on the support member, and with the button abutting against the proximal end of the sliding member.

5. The rotary positioning device as claimed in claim 4, further comprising:

a second housing detachably mounted on the first housing and including a plurality of positioning recesses, with the base disposed between the first and second housings, with the sliding member including a plurality of positioning portions protruded from the top face of the sliding member and selectively engaged with the plurality of positioning recesses of the second housing;

wherein when the sliding member is in the locked position, the plurality of positioning portions of the sliding member is engaged with the plurality of positioning recesses of the second housing;

wherein when the sliding member is in the unlocked position, the plurality of positioning portions of the sliding member is disengaged from the plurality of positioning recesses of the second housing.

* * * * *